US006945326B2

(12) United States Patent
Mikolajczyk

(10) Patent No.: US 6,945,326 B2
(45) Date of Patent: Sep. 20, 2005

(54) NON-ROTATING CEMENT WIPER PLUGS

(76) Inventor: Raymond F. Mikolajczyk, 1031-B Pierre Washington Rd., Broussard, LA (US) 70518

( * ) Notice: Subject to any disclaimer, the term of this patent is extended or adjusted under 35 U.S.C. 154(b) by 0 days.

(21) Appl. No.: 10/308,626

(22) Filed: Dec. 3, 2002

(65) Prior Publication Data

US 2004/0104025 A1 Jun. 3, 2004

(51) Int. Cl.[7] ..... E21B 33/16
(52) U.S. Cl. ..... 166/153
(58) Field of Search ..... 166/177.3, 153, 166/155, 156, 291

(56) References Cited

U.S. PATENT DOCUMENTS 4,836,279 A * 6/1989 Freeman ..... 166/153
5,234,052 A * 8/1993 Coone et al. ..... 166/155
5,433,270 A * 7/1995 LaFleur ..... 166/153

* cited by examiner

*Primary Examiner*—David Bagnell
*Assistant Examiner*—Matthew J. Smith
(74) *Attorney, Agent, or Firm*—Jesse D. Lambert

(57) ABSTRACT

A non-rotating cement wiper plug has an insert, with inner and outer telescoping sleeves, within a resilient outer body. The outer body has annular fins which bear against a casing wall. The inner sleeve has a tapering nose within a tapered cavity in the outer sleeve. Slots in the outer sleeve form a plurality of segments. The inner and outer sleeves are preferably of a frangible material. When the plug is pumped down and lodges against downhole float equipment, pump pressure compresses the plug, forces the inner sleeve down within the outer sleeve, forces the segments radially outward, and fractures or separates the outer sleeve segments. The outer body is forced against the casing wall so tightly that it cannot rotate in response to the forces from a rotary drill bit. Lock surfaces on the inner and outer sleeves lock them together and maintain the outer body in its forced-outwardly position.

25 Claims, 6 Drawing Sheets

NON-ROTATING CEMENT WIPER PLUGS

BACKGROUND

1. Field of Invention

This invention relates to equipment used in connection with the cementing of casing strings in earthen boreholes. More particularly, this invention relates to wiper plugs used in the cementing process.

2. Description of Prior Art

In the field of drilling earthen boreholes or "wells," particularly wells for oil and gas production, each section of open hole (that is, the hole drilled in the earth) is generally cased off by a length of iron or steel casing placed into the borehole. This length of casing is commonly referred to as a "casing string." Some of the purposes of casing are to maintain the structure of the sediment surrounding the hole, as well as to prevent contamination of any nearby oil or water structure. Other purposes relate to the containment of drilling fluids needed to control subsurface pressures. At the very bottom of the casing string is usually a "float shoe," and one or more (but generally no more than two or three) joints up (commonly called "shoe joints") is a "float collar." Both the float shoe and float collar usually contain one-way or check valves, which permit pumping of fluids (including drilling fluids and cement) down through the float collar and float shoe, yet prevent fluid flow in the reverse direction, or back into the interior of the casing string.

Typically, after the casing string is lowered into the hole, it is cemented in place. A typical cementing procedure is to insert a first or bottom plug into the casing string. One of the purposes of the bottom plug is to wipe the inner wall of the casing string substantially free from any debris, and any drilling mud adhering to the inner casing wall, that may potentially impede the cementing process. Yet another purpose is to separate the cement slurry from the drilling mud preceding it. The bottom plug is pumped downhole by the cement slurry. Following the cement slurry is usually a second wiper plug, called the top plug. Thereafter, the two plugs with the cement volume therebetween are pumped downhole by a volume of drilling fluid or mud. The top plug also serves as a barrier between the cement slurry and the drilling mud used as the displacing fluid.

Once the bottom plug reaches the float collar, pumping pressure is increased until the diaphragm in the bottom plug ruptures, allowing the cement to flow through the plug, then through the float collar and float shoe, and outward and upward into the annulus between the casing and the open borehole and/or previous casing string. Pumping continues until the top plug reaches the bottom plug (which is lodged against the float shoe), at which point an increase in the pump pressure shows that the top plug has "bumped."

Problems arise where drilling is to continue beyond the casing string depth. The initial "drillout" must drill through both wiper plugs, the float equipment, and the cement in the shoe joint or joints. A potential problem is that one or both of the wiper plugs, which as described earlier have "landed" on the float collar (or float shoe, if no float collar has been run), spin or rotate along with the rotary drill bit, rather than remain rotationally locked in place for easy drillup. Obviously, as long as the plug or plugs spin along with the bit, little or no progress in drilling therethrough can be made, and in some instances much time, and consequently money, is lost. The problem, then, is how to keep the plugs from spinning beneath the drill bit during the drillout procedure.

To combat this problem, prior art has suggested the use of matching teeth or locks on both the float equipment and the wiper plugs. Generally, this solution requires cement wiper plugs and float equipment that are specially made, one for the other, in order to work. Typically, the upper end of the float collar and the lower and upper end of the bottom plug and the lower end of the top plug are provided with matching teeth, intended to mesh together and rotationally lock the plugs together and lock the plugs to the float equipment. Other solutions involve threaded or J-lock engagements between cement wiper plugs and float equipment.

However, a common drawback to the prior art apparatus is the requirement of matched float equipment and cement wiper plugs and/or additional labor and equipment in order to achieve the rotationally locking functions. While the cementing function can be carried out with whether or not the float equipment and plugs have some sort of matching, meshing teeth or other profiles, it can be readily seen that without the matching aspect, the rotationally locking situation will not be achieved. The requirement of "matched" float equipment and plugs gives rise to increased cost, and the ever-present possibility of mismatched equipment being used in the hectic nature of oilfield work.

Yet another limitation of prior art, matched plugs and float equipment is the possibility of a build-up of debris on the matching or mating components, such as teeth, of the cementing equipment, or a fluid flow-back through the float equipment which would separate the plug from the float equipment and therefore unseat the meshing lock profiles. Such a build-up of debris or fluid flow-back often impedes the mating of the matching components, consequently the cement wiper plugs do not rotationally lock in place.

Yet another attempt seen in the prior art to address this problem involves fixing (by adhesive or other means) an internally splined sleeve within the joint of casing immediately above the float collar, into which the wiper plugs are forced. A drawback to this apparatus is binding of the drill bit when the assembly is drilled up, and the ever-present possibility of an incorrect non-rotating sleeve installation.

Therefore, what is needed is a cement wiper plug that rotationally locks into place, without the need of specialized float equipment to engage teeth or other meshing profiles in the wiper plug for rotationally locking the wiper plugs, and that does not pose issues with rotationally binding the drillout assembly.

SUMMARY OF THE INVENTION

The present invention comprises a cement wiper plug which rotationally locks into place within a casing string, by the application of linear force to the wiper plug, generated by fluid pressure on the plug, which in turn generates radially outward forces that force the outer body of the plug tightly against the casing wall. The cement wiper plug comprises an inner, telescoping two-piece insert comprising inner and outer sleeves. The insert is contained within an outer body, generally of a flexible material such as an elastomer or rubber. Annular fins on the outer body bear against the inner casing wall, wipe the inner wall clean and provide a fluid seal across the length of the plug. Preferably, the insert is molded within the outer body. The outer body and/or fins are forced against the casing wall so tightly that friction forces prevent the plug from rotating in response to drill bit forces.

DESCRIPTION OF THE PRESENTLY PREFERRED EMBODIMENT

While the present invention may be made in a number of different embodiments, with reference to the drawings some of the presently preferred embodiments will be described. Those skilled in the relevant art will recognize that departures may be made from the described embodiments, while still falling within the scope of the present invention.

Figure 1:
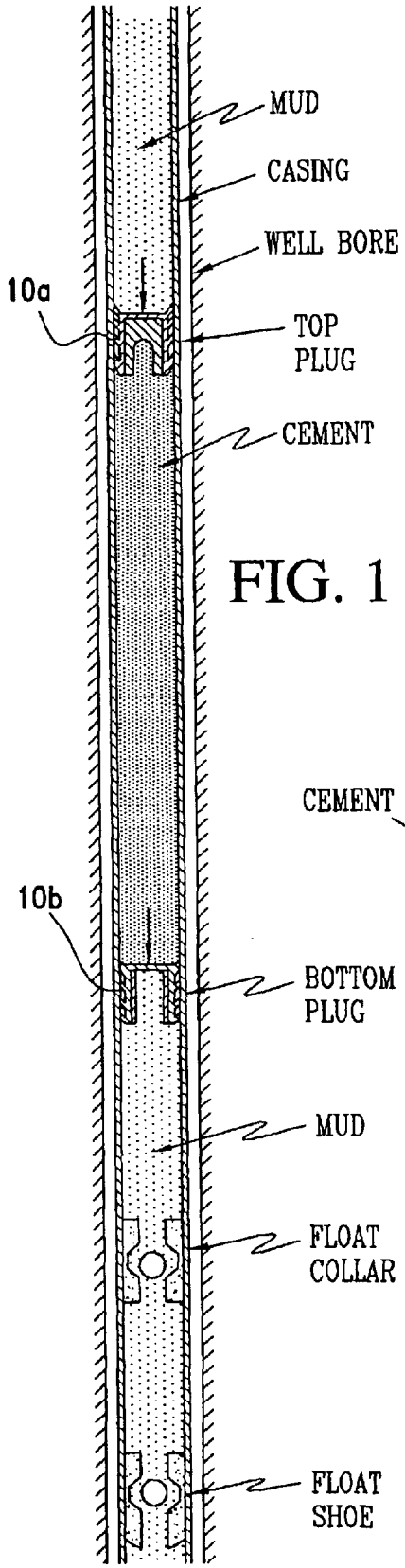
FIGS. 1–3 show a sequence of cement placement using the wiper plug of the present invention.
Figure 2:
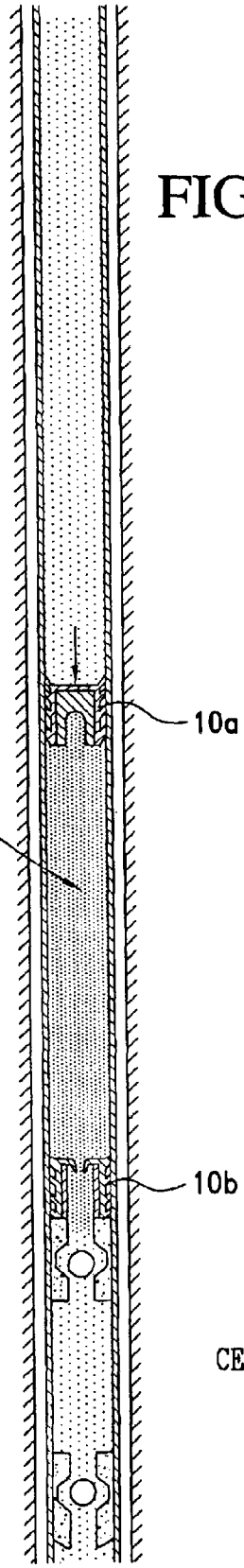
Figure 3:
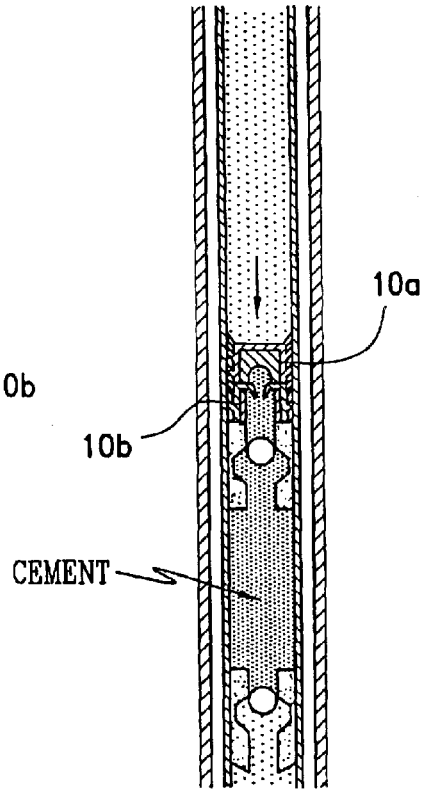

FIGS. 1–3 set forth a typical cement pumping sequence, with the cementing plugs of the present invention. In FIG. 1, a casing string is shown within an earthen borehole. A float shoe is at the bottom of the casing string, and a float collar is installed a short distance uphole in the casing string (typically one to three casing joints up). Both the float shoe and float collar have one-way or check valves therein, which permit fluid flow downwardly through them, but not in the opposite direction. In FIG. 1, a bottom cement wiper plug and a top cement wiper plug (at times referred to hereafter as simply "bottom plug" and "top plug") are being pumped downhole, with a volume of cement slurry sandwiched between the plugs. Typically, drilling mud is pumped downhole to displace the plugs and the cement slurry downhole.

In FIG. 2, the bottom plug has been "bumped" or lodged against the float collar. Continued pumping has ruptured the diaphragm (described in more detail hereafter), and the cement slurry is being displaced into the casing/borehole annulus.

FIG. 3 shows the top plug lodged against the bottom plug, and with increased pump pressure the locking action will take place (as described in more detail hereafter).

Figure 4:
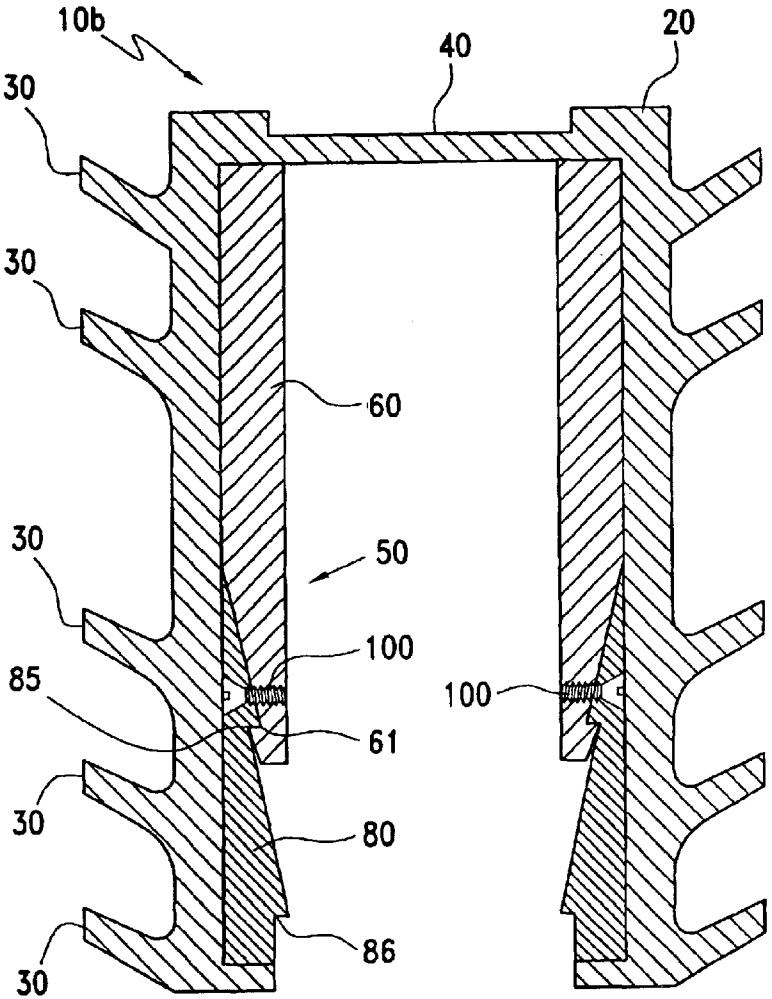
FIG. 4 is a cross section of the bottom plug embodiment.

Now, turning to the cementing wiper plugs of the present invention, FIG. 4 shows an embodiment of the bottom plug of the present invention, in cross-section. Bottom plug 10*b* comprises an outer body 20 having an insert 50 disposed therein. Preferably, outer body 20 is of a resilient material suitable for molding. Various types of rubbers, elastomers, and the like are suitable for cement wiper plugs, as known in the art. At least one annular fin 30 extends radially outwardly on outer body 20, to bear against the inner wall of a casing string. Preferably, there are a plurality of fins 30 to ensure effective cleaning of the casing wall, and a good fluid seal.

In the embodiment of bottom plug 10*b* shown in FIG. 4, a diaphragm 40 is formed in the top surface. Diaphragm 40 is rupturable under fluid pressure, as was described with regard to FIG. 2, so that cement may flow through bottom plug 10*b*. Preferably, the upper surface of bottom plug 10*b* presents a generally flat seating surface for the top plug, as will be later described in more detail. It is understood that diaphragm 40 could alternatively be formed in the lower end of bottom plug 10*b*.

In the preferred embodiment, insert 50 is inserted into the mold when outer body 20 is molded.

Insert 50, as can be seen in FIGS. 4–7, comprises an inner sleeve 60 having a tapered nose section, received within an outer sleeve 80 having a tapered inner cavity. In the embodiment of bottom plug 10*b* shown, both inner sleeve 60 and outer sleeve 80 are generally cylindrical with open ends.

Figure 5:
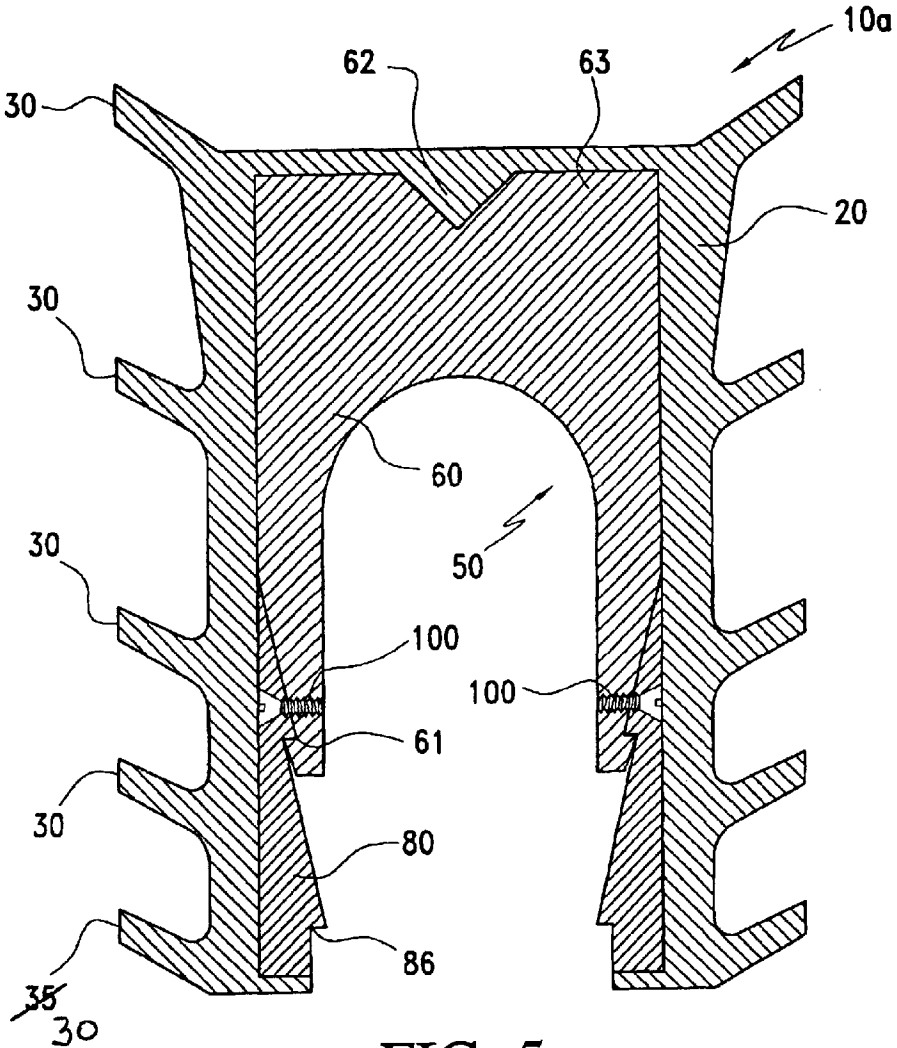
FIG. 5 is a cross section of the top plug embodiment.

Top plug 10*a*, shown in FIG. 5, also comprises outer body 20 and insert 50. As with bottom plug 10*b*, insert 50 is preferably molded within outer body 20 as previously described. The upper surface of top plug 10*a* is generally flat, to provide a good surface for the drill bit to later bite into when the plugs are drilled up.

Figure 9:
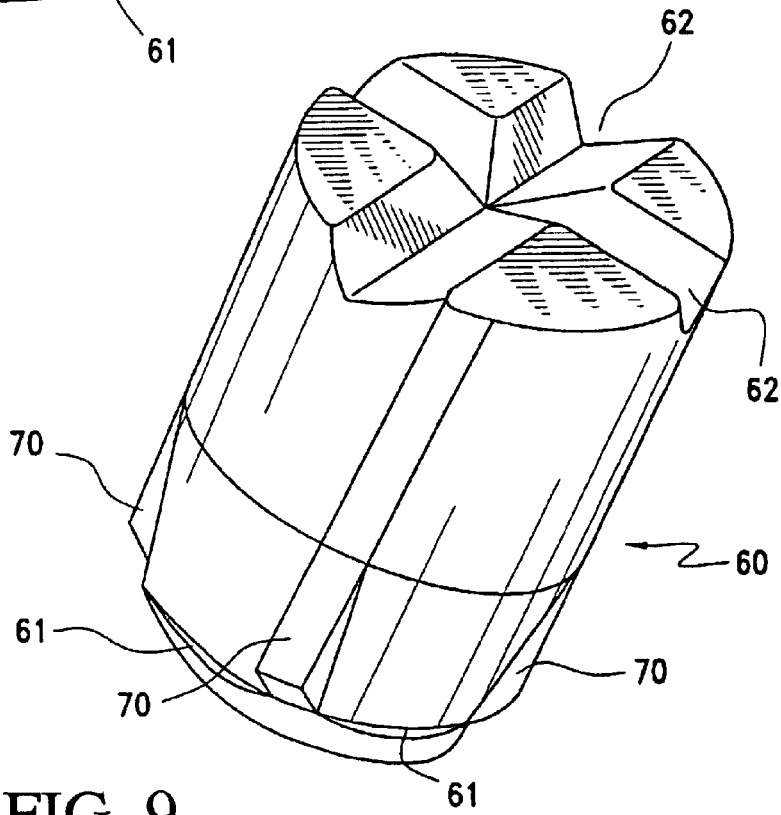

Inner sleeve 60 of top plug 10*a*, rather than being an open cylindrical shape as for bottom plug 10*b*, has a closed top 63, as seen in FIG. 5. Preferably, a pair of crossed grooves 62 form an X-shape across the top surface of inner sleeve 60, as seen in cross section in FIGS. 5–8 and in the perspective view of FIG. 9, to aid in the drill bit biting into inner sleeve 60. Outer sleeve 80 for the top plug shown in FIG. 5 is substantially the same as that described above, in relation to bottom plug 10*b* of FIG. 4.

Figure 6:
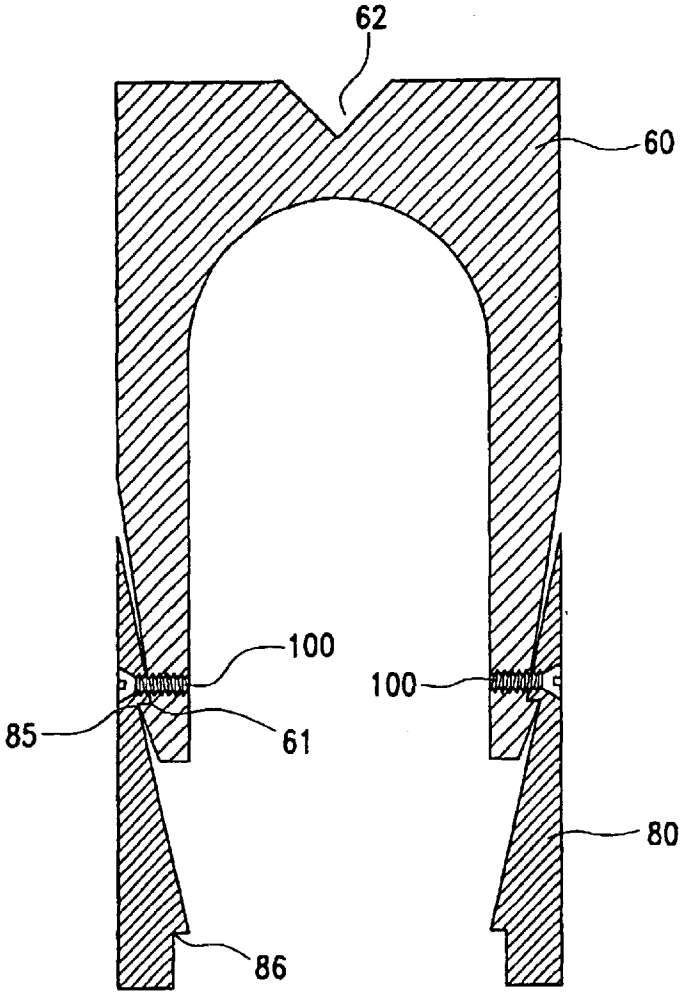
FIG. 6 is a more detailed view in cross section of the inner and outer sleeves of the insert, in a first position.
Figure 8:
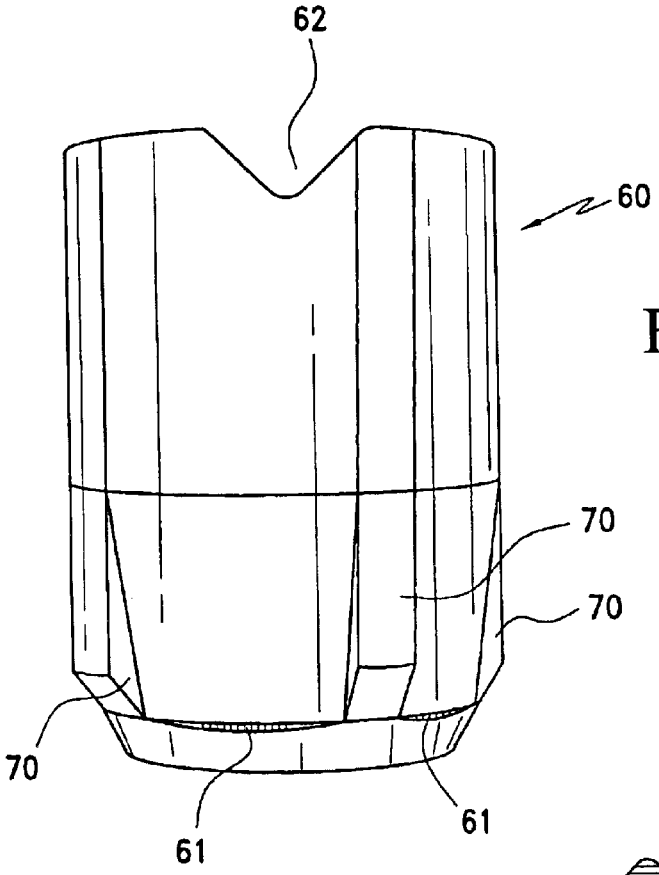
FIGS. 8 and 9 are side and perspective views of the inner sleeve.

The preferred embodiment of the plug comprises lock surfaces on both the inner and outer sleeve, providing locking at two different levels, and preventing longitudinal movement of inner sleeve 60 out of outer sleeve 80. In the preferred embodiment, lock surfaces comprise a pair of mating notches, at two levels. As seen in FIGS. 4–8, inner sleeve 60 (whether for bottom plug 10*b* or top plug 10*a*) has at least one notch 61 on the tapered nose section. As seen in FIGS. 4–7, and 10 and 11 (FIGS. 10 and 11 being side and perspective views, respectively, of outer sleeve 80), outer sleeve 80 has an upper notch 85 and a lower notch 86. In a first position (for either the top or bottom plug), as seen in FIGS. 4, 5, and 6, notch 61 on inner sleeve 60 engages upper notch 85 on outer sleeve 80. In this first position, the engagement of the notches prevents movement of inner sleeve 60 out of outer sleeve 80. Further, in the preferred embodiment, the insert comprises a means for holding inner sleeve 60 and outer sleeve 80 releasably locked together. In the preferred embodiment, the means for holding inner sleeve 60 and outer sleeve 80 releasably locked together can comprise at least one, and possibly a plurality, of shear screws 100, which prevent relative longitudinal or rotational movement between the two sleeves until desired. Instead of shear screws, pins could alternatively be used. It is understood, however, that certain embodiments or sizes of the wiper plugs may not require shear screws, pins, or other means for holding the inner and outer sleeves together.

Figure 10:
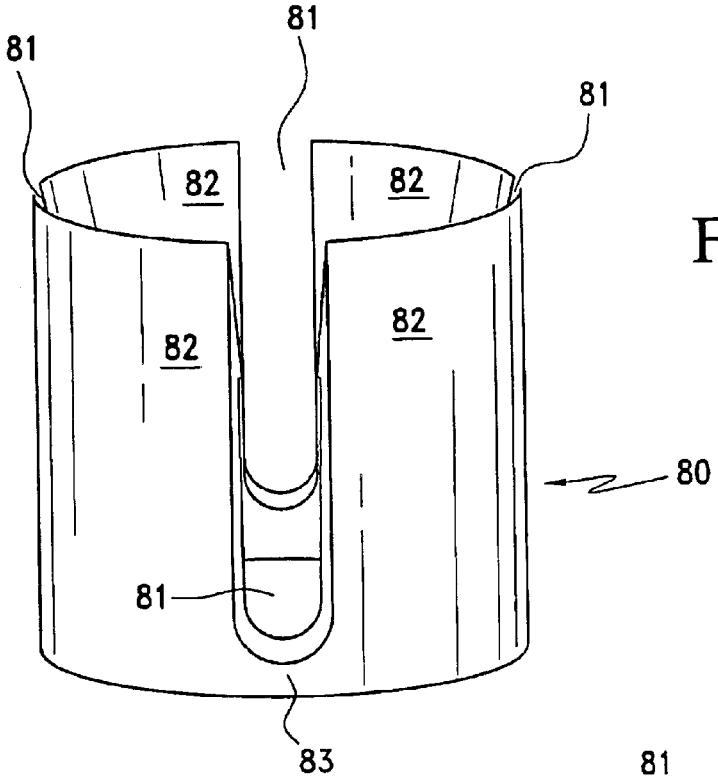
FIGS. 10 and 11 are side and perspective views of the outer sleeve.
Figure 11:
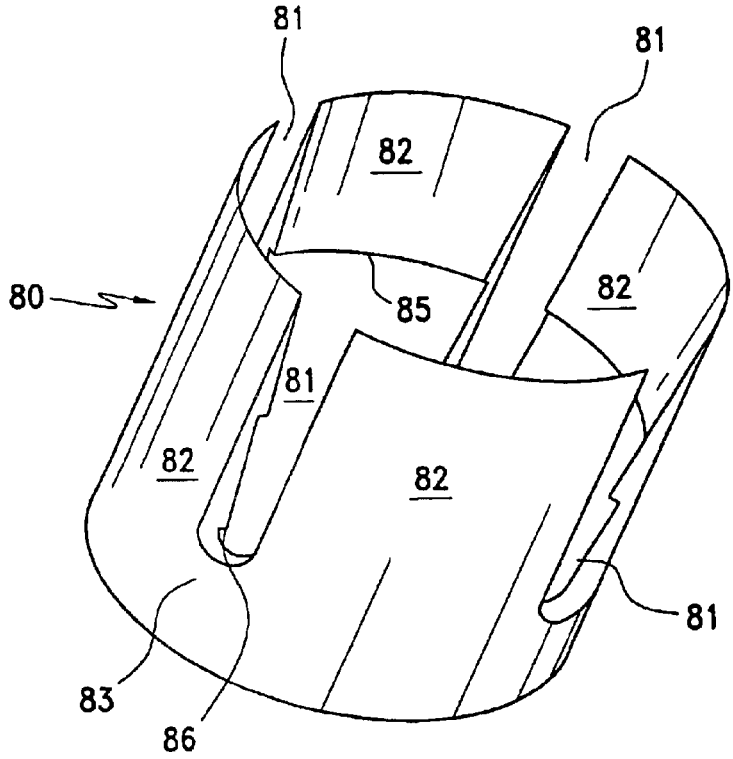

Outer sleeve 80, best seen in FIGS. 10 and 11, comprises a plurality of longitudinal slots 81 which extend from the upper end of outer sleeve 80 to a point short of the lower end of outer sleeve 80, thereby forming a base 83. Slots 81 form a plurality of segments 82. In the preferred embodiment, lugs 70 (easily seen in FIGS. 8 and 9) are formed on inner sleeve 60, which are received in slots 81 and rotationally lock inner sleeve 60 and outer sleeve 80 together. In another presently preferred embodiment of outer sleeve 80, base 83 is not solid but is divided preferably on a line corresponding to each of slots 81, thereby making outer sleeve 80 a plurality of segments. In such embodiment, the segments may be held together with tape or other similar means, while outer sleeve 80 is molded within outer body 20.

Figure 7:
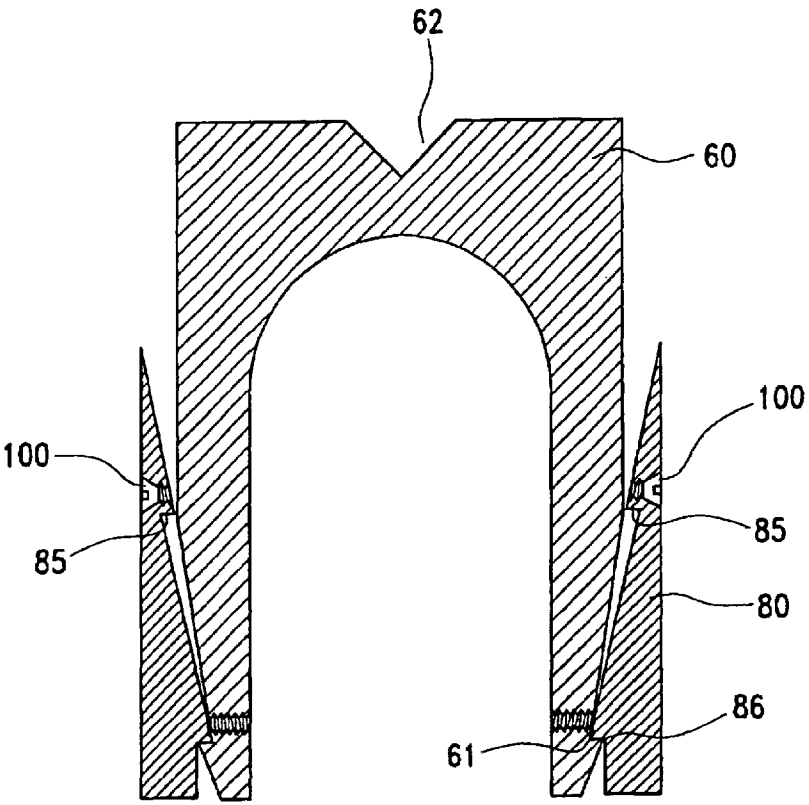
FIG. 7 is a more detailed view in cross section of the inner and outer sleeves of the insert, in a second position.
Figure 12:
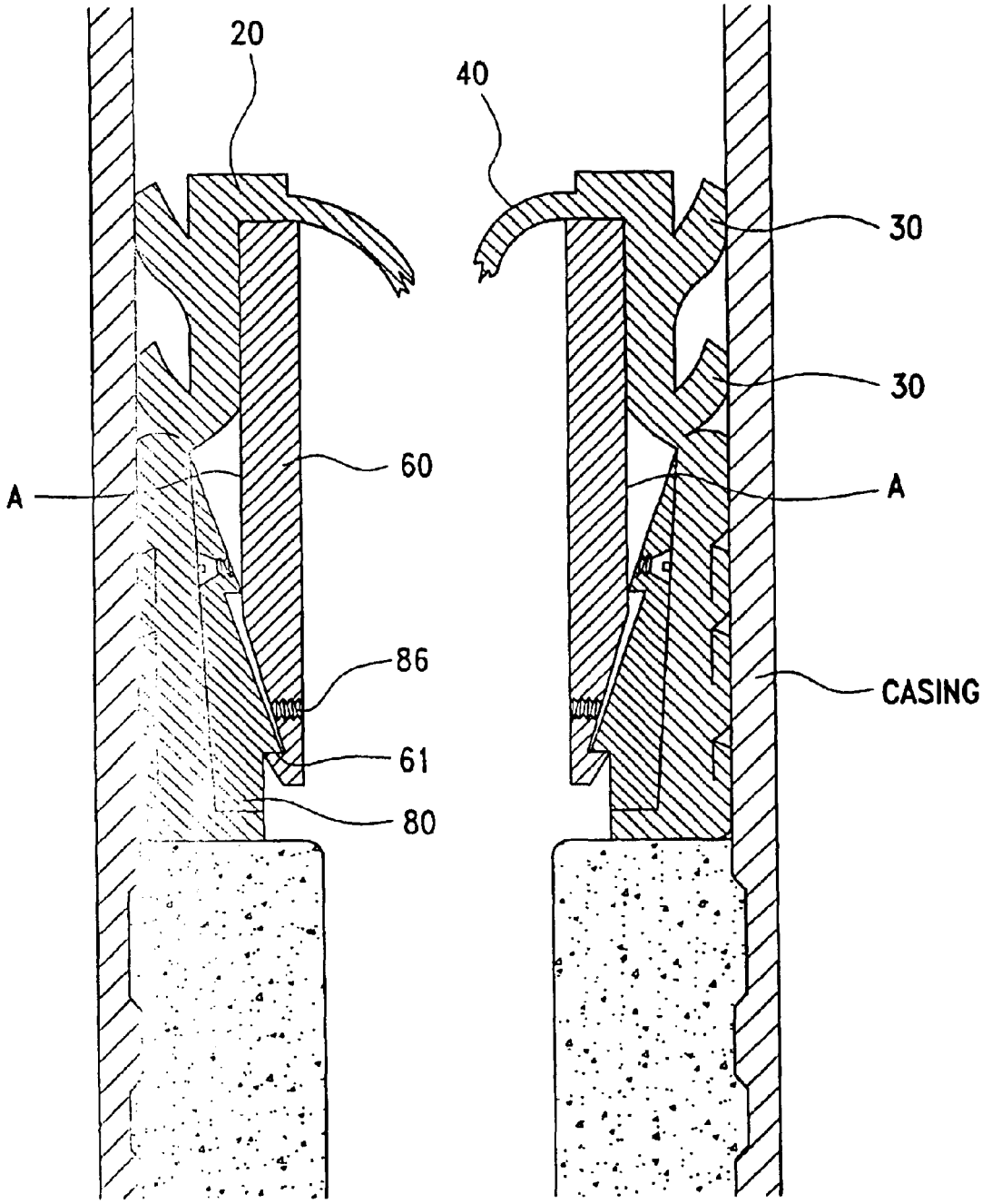
FIG. 12 is a cross section view of a cement wiper plug (bottom plug shown) of the present invention, in the locked position in a casing string.

Referring in particular to FIGS. 6, 7, and 12, the plug of the present invention rotationally locks in place by:

- inner sleeve 60 moving longitudinally downward into outer sleeve 80, fragmenting (or separating the segments of) outer sleeve 80 and forcing segments 82 radially outward;

segments 82 thereby radially expanding outer body 20 outwardly;

expansion of outer body 20 forcing annular fins 30 to a position at least partially collapsed against the casing wall, and pushing so tightly against the casing wall that the resulting friction forces prevent the plug from turning in response to the rotary bit.

A typical sequence of "setting" the plugs, if both top and bottom plugs are used, is as follows. Referring particularly to FIGS. 1–3, both plugs and the cement slurry are pumped downhole until bottom plug 10*b* seats on the float collar. Continued pumping ruptures diaphragm 40, and pumping of the cement slurry through bottom plug 10*b* continues, as seen in FIG. 2. With continued pumping, top plug 10*a* is eventually seated on bottom plug 10*b*. After top plug 10*a* lands on bottom plug 10*b*, FIG. 3, pump pressure is increased (while the degree of over pressure will vary depending upon the exact configuration, over pressure on the order of 1000 psi is typical). This pressure, acting against the cross sectional area of top plug 10*a*, generates a longitudinal force that tends to move both plugs downward, expanding and shortening both plugs. As pressure is applied, shear screws 100 (if present) are first sheared, then inner sleeve 60 is pushed downward into outer sleeve 80. As inner sleeve 60 advances, its tapered nose forces segments 82 radially outward, until base 83 fractures and/or separates (typically along the center lines of slots 81) and segments 82 are separated. The outwardly-expanding segments 82 expand outer body 20, forcing fins 30 against the casing wall, as can best be seen in FIG. 12 (while FIG. 12 shows a bottom plug, it is understood that the top plug will display a similar set position). The flat top surface of the bottom plug allows the top plug to expand. Depending upon the degree of expansion, the wall of outer body 20 may be forced against the casing wall. This process occurs with both top plug 10*a* and bottom plug 10*b*. Inner sleeve 60 moves downward until notch 61 engages lower notch 86, in the position shown in FIG. 7 and FIG. 12. The two sleeves are again locked together, in the sense that inner sleeve 60 cannot move upwardly out of engagement with outer sleeve 80 when pump pressure is removed. With top plug 10*a*, the longitudinal force is due to fluid pressure, and with regard to bottom plug 10*b*, the longitudinal force is created by top plug 10*a* pushing down on bottom plug 10*b*. The expansion of outer body 20 against the casing wall generates such high frictional forces that the plugs are rotationally fixed in place, to prevent them turning under the rotary drill bit. Note that in the preferred embodiment, outer body 20 is preferably not bonded to inner sleeve 60 in the area indicated as "A" in FIG. 12, to ease outer body 20 being pushed away from inner sleeve 60 and to expand against the wall of the casing.

It is understood that the scope of this invention encompasses either plug used by itself. For example, in certain cementing operations only one cement wiper plug is used. While if only one plug is used, it does not matter whether or not is configured like the "top" plug or the "bottom" plug herein described, most commonly a top or solid plug configuration is used when only one plug is run. Therefore, the scope of the present invention is not limited to a pair of plugs used in tandem, but encompasses either plug by itself.

The outer body and insert may be dimensioned to accommodate a number of different casing diameters and wall thicknesses. In addition, the cross-sectional shapes of the inner sleeve and outer sleeve may not be circular, but may be some non-circular shape such as a square, pentagon, hexagon, etc., in which case the mating non-circular shapes provide the rotational locking aspect of the invention, and the intersecting planar lines in the outer body can serve as the fracture or separation lines.

With regard to materials suitable for the invention, a number of different ones may serve. For the outer body, a generally resilient material, such as many different types of elastomers, polyvinyls, and rubbers well known in the relevant art may be used. The insert is preferably, although not exclusively, of a frangible material such as phenolic resin. Other plastics known in the art may serve as well. Since in the preferred embodiment the insert is molded within the outer body (that is, the molten material for the outer body is poured around the insert), then the insert material must be capable of withstanding relatively high temperatures without itself melting. Other materials which are readily drilled with a drill bit, for example metallic alloys such as aluminum alloys, may also be used to form the insert.

While the preceding description contains many details about the presently preferred embodiments of the invention, it is understood that same are presented by way of example and not limitation. A number of variations can be implemented while still falling within the scope of the invention. As to the outer body, variations in the number of fins and the contours of the body may be made. A variety of materials may be used for the outer body, as known in the art. Dimensions may be changed to correspond to many different casing diameters and wall thicknesses. As described above, the outer body may be configured for use either as a bottom plug (with a rupturable diaphragm) or a top plug. With regard to the insert, changes in the shape and dimensions may be made to suit different applications. The inner sleeve of the insert may be made with or without the lugs which engage the slots in the outer sleeve and tend to rotationally lock the inner and outer sleeves together. Further, embodiments may omit the shear screws, or have some other means of releasably holding the inner and outer sleeves together until pump pressure forces the inner sleeve downwardly with respect to the outer sleeve.

Therefore, the scope of the invention is not to be limited to the specific examples given, but by the scope of the appended claims and their legal equivalents.

I claim:

1. A non-rotating wiper plug, comprising:

a) a resilient outer body, comprising at least one annular fin; and b) an insert disposed within said outer body, said insert comprising an inner sleeve and a generally cylindrical outer sleeve, said inner sleeve atop said outer sleeve when said wiper plug is in position within a casing string, said inner sleeve comprising a tapered nose received within a tapered cavity within said outer sleeve, a wall of said outer sleeve further comprising a plurality of longitudinal slots which divide said wall of said outer sleeve into a plurality of segments, whereby when said inner sleeve is forced longitudinally into said outer sleeve, said tapered nose forces said plurality of segments apart thereby separating said segments, and wherein said inner sleeve and said outer sleeve comprise mating lock surfaces which, once engaged, prevent longitudinal movement of said inner sleeve out of said outer sleeve.

2. The cement wiper plug of claim 1, wherein said inner sleeve further comprises a plurality of lugs disposed on an outer surface thereof, said lugs received within said longitudinal slots of said outer sleeve.

3. A non-rotating wiper plug, comprising:

a) a resilient outer body, comprising at least one annular fin; and b) an insert disposed within said outer body, said insert comprising an inner sleeve and a generally cylindrical outer sleeve, said inner sleeve comprising a tapered nose received within a tapered cavity within said outer sleeve, a wall of said outer sleeve further comprising a plurality of longitudinal slots which divide said wall of said outer sleeve into a plurality of segments, whereby when said inner sleeve is forced longitudinally into said outer sleeve, said tapered nose forces said plurality of segments apart thereby separating said segments, and wherein said inner sleeve and said outer sleeve comprise mating lock surfaces which, once engaged, prevent longitudinal movement of said inner sleeve out of said outer sleeve, and wherein said inner sleeve is generally cylindrical and open at both ends forming a bore therethrough, and further comprises a plurality of lugs disposed on an outer surface thereof, said lugs received within said longitudinal slots of said outer sleeve, and wherein said outer body comprises a diaphragm covering said inner sleeve bore.

4. The cement wiper plug of claim 3, further comprising a means for holding said inner sleeve and said outer sleeve releasably locked together.

5. The cement wiper plug of claim 4, wherein said means for holding comprises shear screws joining said inner sleeve and said outer sleeve.

6. The cement wiper plug of claim 4, wherein said means for holding comprises pins joining said inner sleeve and said outer sleeve.

7. The cement wiper plug of claim 4, wherein said inner and outer sleeves are of a frangible plastic.

8. The cement wiper plug of claim 7, wherein said frangible plastic is a phenolic resin.

9. The cement wiper plug of claim 3, wherein said outer body comprises a flat upper bearing surface.

10. The cement wiper plug of claim 3, wherein said inner sleeve comprises a solid closed top.

11. The cement wiper plug of claim 10, further comprising a means for holding said inner sleeve and said outer sleeve releasably locked together.

12. The cement wiper plug of claim 11, wherein said means for holding comprises shear screws joining said inner sleeve and said outer sleeve.

13. The cement wiper plug of claim 11, wherein said means for holding comprises pins joining said inner sleeve and said outer sleeve.

14. The cement wiper plug of claim 10, wherein said solid closed top comprises at least one transverse groove across said top.

15. The cement wiper plug of claim 10, wherein a lower nose of said outer body is adapted to seat atop a flat upper surface of a mating plug.

16. The cement wiper plug of claim 3, wherein said longitudinal slots in said wall of said outer sleeve terminate above a lower end of said outer sleeve, forming a solid base joining said segments, and when said inner sleeve is forced longitudinally into said outer sleeve, said tapered nose forces said plurality of segments apart and fractures said base.

17. A cement wiper plug, adapted to rotationally lock in place within a casing string, comprising:

a) a resilient outer body, comprising a plurality of outwardly extending annular fins; and b) an insert disposed within said outer body, said insert comprising an inner sleeve having a tapered nose received within a tapered cavity in a generally cylindrical outer sleeve having a wall, said inner sleeve further comprising a plurality of lugs disposed in a plurality of longitudinal slots dividing said wall into a plurality of segments joined by a base, whereby when said inner sleeve is forced longitudinally into said outer sleeve, said tapered nose forces said plurality of segments apart and fractures said base;

c) grooves disposed on an outer surface of said inner sleeve, and an inner surface of said outer sleeve, which longitudinally lock said inner and outer sleeves together when engaged;

whereby when said segments are forced radially outward, said outer body expands and forces said annular fins against an inner casing wall such that said cement wiper plug does not rotate when a rotary drill bit engages said cement wiper plug.

18. The cement wiper plug of claim 17, further comprising means for releasably locking said inner and outer sleeves together.

19. The cement wiper plug of claim 18, wherein said means for releasably locking said inner and outer sleeves together comprises at least one shear screw.

20. The cement wiper plug of claim 19, wherein said inner sleeve comprises an open cylindrical body, and outer body comprises a rupturable diaphragm covering said open cylindrical body.

21. The cement wiper plug of claim 20, wherein said inner sleeve comprises a solid top.

22. The cement wiper plug of claim 21, wherein said solid top comprises at least one groove therein.

23. The cement wiper plug of claim 17, wherein said insert is formed of a frangible material.

24. The cement wiper plug of claim 23, wherein said insert is of a phenolic resin.

25. The cement wiper plug of claim 23, wherein said insert is of a metallic alloy.

* * * * *